United States Patent [19]

Cramer

[11] Patent Number: 4,815,622

[45] Date of Patent: Mar. 28, 1989

[54] SECTIONAL CONTAINER FOR HOLDING AND DISPLAYING ARTICLES

[75] Inventor: Ronald G. Cramer, Racine, Wis.

[73] Assignee: S. C. Johnson & Son, Inc., Racine, Wis.

[21] Appl. No.: 172,530

[22] Filed: Mar. 24, 1988

[51] Int. Cl.[4] ..... B65D 5/32

[52] U.S. Cl. ..... 220/4 B; 206/443; 206/518; 206/214

[58] Field of Search ..... 206/443, 518, 214; 220/23.4, 4 B

[56] References Cited

U.S. PATENT DOCUMENTS

| | | | |
|---|---|---|---|
| 208,154 | 3/1976 | Cleveland . | |
| 270,617 | 9/1978 | Skowronski . | |
| 276,024 | 4/1918 | Skowronski . | |
| 3,196,229 | 7/1976 | Glass . | |
| 3,308,962 | 5/1988 | Bryant . | |
| 3,325,000 | 1/1979 | Edwards . | |
| 3,968,879 | 7/1976 | Livcas, Sr. et al. | 220/4 B |
| 4,282,975 | 10/1976 | Ovadia . | |
| 4,314,641 | 2/1977 | Bronne . | |
| 4,402,423 | 6/1988 | Skowronski . | |
| 4,510,119 | 5/1977 | Hevey . | |
| 4,619,363 | 11/1977 | Wolfseder . | |
| 4,749,097 | 6/1988 | Rosman | 220/4 B |

*Primary Examiner*—George T. Hall

[57] ABSTRACT

A sectional container is disclosed having at least a front section and a back section which interlock to form a closed package. The back of the front section serves to close the front of the back section, and vice versa. Optionally, the sectional container can have one or more intermediate sections which fit in an interlocking relationship to the back section or between the front section and the back section in order to enlarge the holding capacity of the container. The intermediate sections are identical and are interchangeable. Additionally, the back section can be identical with the intermediate sections. The sectional container is useful to store, display, and dispense a plurality of items.

18 Claims, 2 Drawing Sheets

SECTIONAL CONTAINER FOR HOLDING AND DISPLAYING ARTICLES

FIELD OF THE INVENTION

The present invention is directed to a sectional container having two basic interlocking sections, a front section and a back section, wherein the back of the front section serves to close the front of the back section, or vice versa. Any number of interlockable intermediate sections can be positioned behind the back section or between the front and back sections to enlarge the holding capacity of the container. The intermediate sections are identical and interchangeable. The back section can be identical to the intermediate sections. The sectional container is useful to store, display, and dispense a plurality of items.

BACKGROUND OF THE INVENTION

Numerous forms of containers are known in the art for storing, displaying and dispensing articles, including containers having a plurality of interfitting sections held together by a fastening means. Various forms of fastening means for joining shaped articles together are known in the art. Examples of container and fastener structures known in the art include U.S. Pat. No. 3,325,000 which discloses a package for dispensing articles, such as cigars. In one embodiment, individual sections are seated front to back, with the topmost section having a lid. The sections are held together by frictional engagement due to the shape of the bottom of one section and the shape of the top of another section.

U.S. Pat. No. 3,308,962 which discloses a pill organizer utilizing a number of identical containers having a shape such as shown in FIG. 4. The containers are stacked so that the bottom of one container fits in the top of another container and acts as a cover for that other container. The topmost container has a lid. The containers are held together by frictional engagement.

U.S. Pat. No. 208,154 which discloses a holder for lead pencils, crayons, or the like having a complementary top and bottom which are hingedly connected. FIG. 5 discloses a nest of a plurality of cases. A pin is utilized to keep the cases from shifting position. The nest of cases utilize a top and bottom section, with alternating appropriate sided sections positioned in between.

U.S. Pat. No. 2,723,484 which discloses a packaging and display case for fish lures. A complete container, i.e., a container having a connected top and bottom portion, are joined together utilizing a T-bar and a complementary recess.

U.S. Pat. No. 3,194,426 which discloses laterally interlocked containers. The containers have complementary interlocking parts formed in their sides. The interlocking parts can have differing complementary shapes.

U.S. Pat. No. 4,624,383 which discloses containers joined side to side by interlocking connections. The connections are formed as an integral part of the container side.

U.S. Pat. No. 4,368,817 which discloses a box having a hingedly connected top which can be connected to other identical boxes utilizing connections, shown in FIG. 7, formed as an integral part of the box's corners.

U.S. Pat. No. 3,862,683 which discloses a container for holding ink having connectors formed as an integral part of its sidewalls so that any quantity of identical containers can be joined together.

U.S. Pat. No. 3,506,321 which discloses interconnected detachable boxes. The connecting means utilizes cutouts in one box which engage corresponding cutouts of the box to be connected.

U.S. Pat. Nos. 4,402,423; Des. 270,617; and Des. 276,024 which disclose a packaging system wherein the container has projecting ridges on its face which can engage grooves contained in an identical container's back. This allows for stacking of identical boxes.

U.S. Pat. No. Des. 219,369 which discloses a combined display panel and packing box for a tape cartridge. The container does not have means for joining with other containers.

U.S. Pat. No. Des. 247,025 which discloses a stackable packaging tray having sidewall ridges which allow the tray to be seated within an identical tray.

None of the above-described patents disclose a sectional container with interfitting sections having a structure and fastening means which allows interlocking of detachable sections to present a container having the appearance of a singular unit such as provided by the present invention.

OBJECTS OF THE INVENTION

A primary object of the present invention is to provide a sectional container having at least two sections, a front section and a back section, where the back of the front section closes the front of the back section, or vice versa, in an interlocking relationship.

A further primary object of the present invention is to provide a sectional container made up of a plurality of interlocking sections whose holding capacity can be increased by adding any desired number of identical intermediate sections to the container.

A further primary object of the present invention is to provide a sectional container made up of a plurality of interlocking sections wherein the interlocking means is formed as an integral part of the sections.

A further primary object of the present invention is to provide a sectional container made up of a plurality of sections which, with the exception of the front-most section, are interchangeable and, accordingly, are easily assembled and reassembled after use.

A further primary object of the present invention is to provide a sectional container made up of a plurality of interlocking sections suitable for holding a plurality of items.

A further primary object of the present invention is to provide a sectional container made up of a plurality of interlocking sections which (1) gives the appearance of a singular unit; (2) is compact, sturdy, and suitable for displaying the contained items; (3) can be disassembled to provide individual sections for holding and dispensing the contained items during use of the contained items, and (4) is easily reassembled for subsequent use.

A further primary object of the present invention is to provide a method of assembling the sectional container described herein.

BRIEF SUMMARY OF THE INVENTION

The present invention provides a sectional container having at least a front section and a back section which are interlockable to form a closed package. In a preferred embodiment the sections are rectangular in shape. A recess is situated in each rear corner of the front section, and a projection is situated in each corner on the face of the back section. The projections on the back section fit into the recesses in the front section, thereby interlocking the two sections to form a single container.

Additionally, the back section of the container can have a recess in each rear corner so that additional back sections having the identical configuration as the preceding back section can be fit into the back section. This feature allows the sectional container to have numerous sections so that a varying number of items can be held. For each additional section added to the container, the quantity of items which can be held in the container is proportionally increased.

While all the back sections of the sectional container can be identical no matter how many sections are added together, the back section forming the terminal end of the container can have a smooth face so as to present an aesthetically pleasing and finished appearance. When the back section has a smooth rear face, the additional sections joined in the container are then situated between the front section and back section, i.e., are intermediate sections.

The front section of the sectional container preferably has a smooth face so as to present a pleasing exterior. The front section acts as a sealing face for the back section or intermediate sections no matter how many sections are joined.

The sectional container can also have various additional features such as a hanger to allow display of the container on a rack, or a sharpener when the container is utilized to hold crayons, pencils, or other devices capable of being sharpened.

As will be apparent according to the present invention, the location of the recesses and projections can be reversed.

PRESENTLY PREFERRED EMBODIMENT OF THE INVENTION

The sectional container of the present invention is especially suited for holding a plurality of items, such as crayons, pens, pencils, or other rod-like instruments. The preferred shape of the individual sections of the sectional container is a square or rectangle. This shape allows storage of rod-like instruments without the use of any internal partitions. However, any polygonal shape is usable. If a shape other than a rectangle or square is utilized to hold rod-like instruments, however, internal partitions may be required to hold the items in an organized manner. If a nonrod-like item is held in the container, whether any modification to the interior of the container is required will be obvious to one skilled in the art in view of the item or items being stored.

Without limiting the scope of the invention, the invention will be described in terms of a sectional container having a rectangular shape and which is utilized for holding a plurality of crayons.

Figure 1:
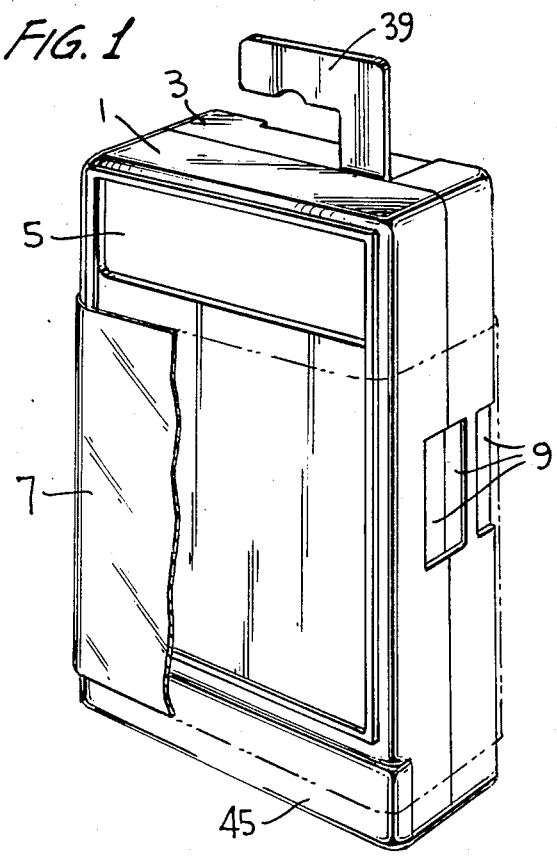
FIG. 1 is a perspective view of the sectional container of the present invention with the face of the front section showing.

FIG. 1 shows the sectional container of the present invention having a front section 1 and a back section 3 which are interlocked to form the container.

Figure 3:
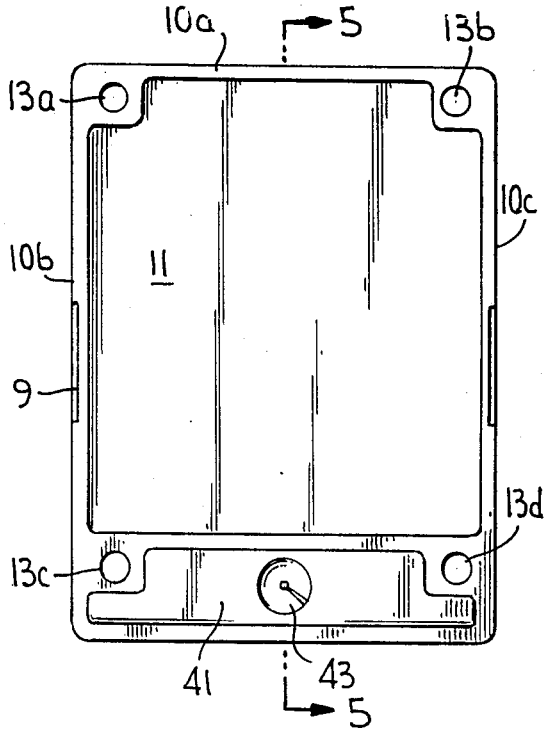
FIG. 3 is a planar view along line 3—3 of the front section of FIG. 2.
Figure 2:
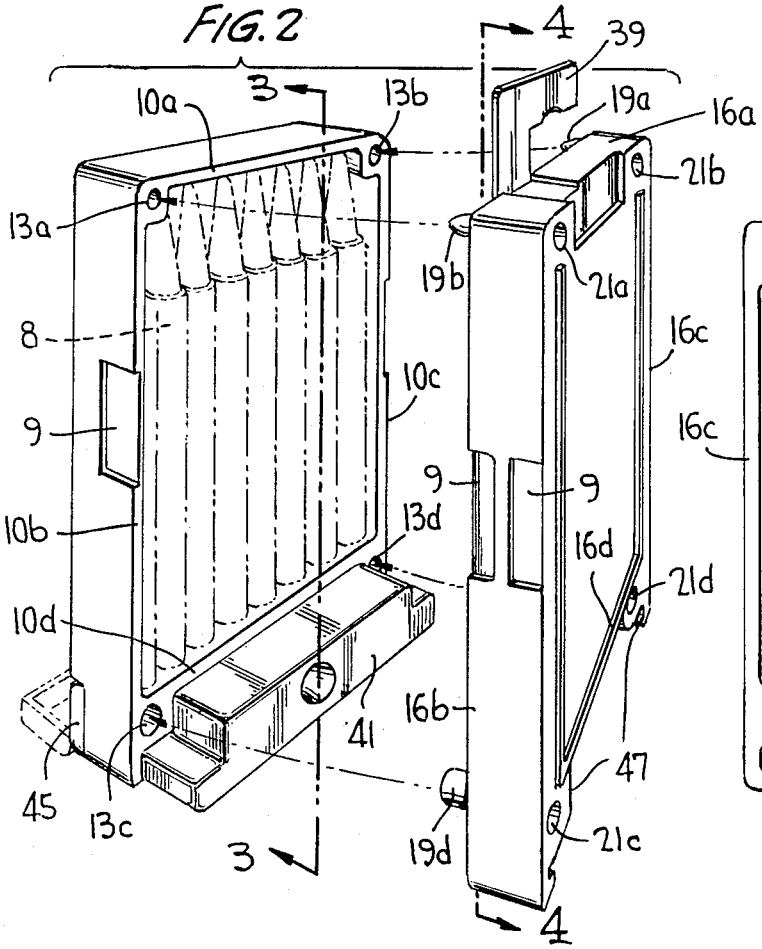
FIG. 2 is a perspective, exploded view of the sectional container showing primarily the rear of the back section and the rear of the front section.
Figure 5:
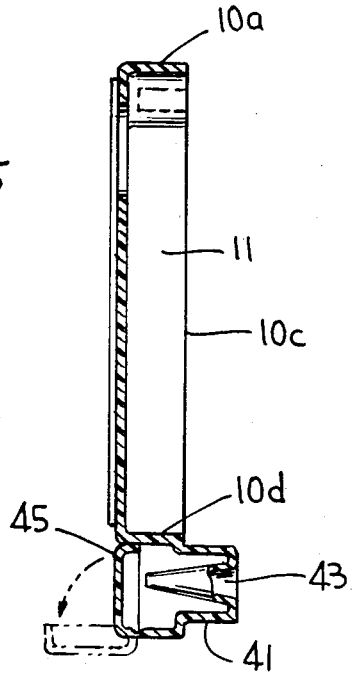
FIG. 5 is a cross-section along line 5—5 of FIG. 3.

The front section 1 of the sectional container, such as shown in FIG. 1, preferably has a smooth face so as to present a pleasing exterior to the consumer. As shown in FIGS. 2, 3 and 5, the front section has an open-ended backside. The sidewalls 10*a*, 10*b*, 10*c*, and 10*d* of the front section form a cavity 11 for holding a plurality of items, such as crayons 8. The corners located at the rear face of the front section sidewalls, where the sidewalls meet or join to form an angle, have a sufficient thickness so that recesses 13*a*, 13*b*, 13*c*, and 13*d* can be formed in the area of each angle formed. In the case of a rectangular or square shaped front section, the angle formed is a right angle. If an alternate polygonal shape for the section is used, such as a pentagon, a different sized angle would be formed at the point where each of the sidewalls join.

The back section 3 of the sectional container has a shape corresponding to the shape of the container's front section, in this instance a rectangular shape. As with the front section, the back section has sidewalls 16*a*, 16*b*, 16*c*, and 16*d* which form a cavity 17 in the back section for holding a plurality of items, such as crayons. Additionally, as with the front section, the sidewalls are of a sufficient thickness to provide an area at the corners of the rectangle to allow a projection, i.e., 19*a*, 19*b*, 19*c* and 19*d*, to protrude from each corner of the back section. These projections 19*a*–19*d* will be seated respectively in recesses 13*a*–13*d* of the front section when the front section and back section are placed together in a facing relationship so that the projections and recesses are aligned and the sections are moved together causing the projections to become seated within the recesses. The projections and recesses are complementary in shape and provide the interlocking fastening means for the sectional container.

The preferred form of interlocking means is a smooth, rounded projection which frictionally fits within a complementary recess such as shown in the drawing. However, the interlocking means can take any suitable complementary shape, such as a squared or pointed projection fitted within a complementary recess, or a projection which can be snap-fitted into a complementary recess such as through the use of a projection having a groove or ridge and a recess having a complementary ridge or groove.

The back section preferably also has recesses 21*a*, 21*b*, 21*c*, and 21*d* formed in the rear face wall area where the sidewalls of the back section join to form an angle. However, if desired, such recesses can be omitted. The purpose of these recesses is discussed below in relation to the intermediate sections.

As shown in FIGS. 1–4, each section is capable of holding eight crayons of conventional size. If additional crayons are desired to be held within the same sectional container, an additional section or sections can be joined to the container. One or more intermediate sections can be interlocked to the rear of the back section or can be positioned in interlocking relationship between the front and back sections, thereby increasing the capacity of the sectional container by eight for each intermediate section added to the container. Whether the additional section is positioned between the front and back sections or interlocked to the rear of the back section, the additional section will be referred to as an intermediate section for purposes of discussion and the claims.

Figure 4:
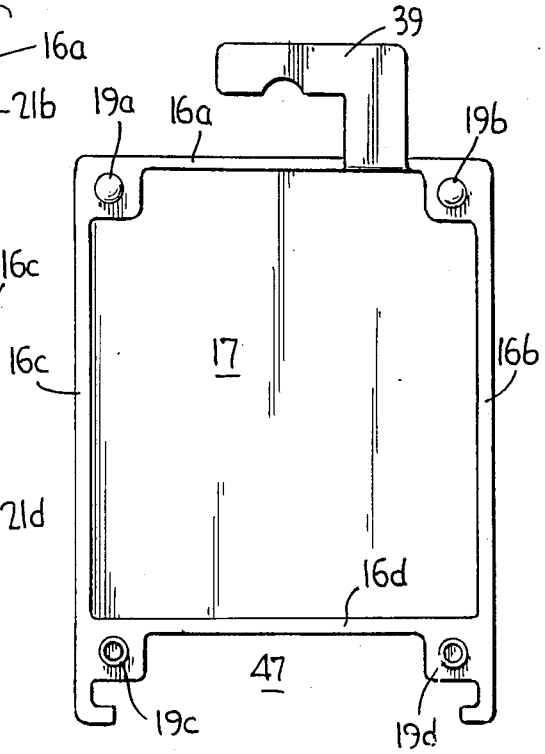
FIG. 4 is a planar view along line 4—4 of the back section of FIG. 2.

The intermediate section or sections have a shape identical to the back section as shown in FIGS. 2 and 4. The intermediate sections, however, are required to have recesses such as 21*a*–21*d* formed in each rear face corner. The projections on the intermediate section(s) fit either within the recesses formed in the front section, the recesses formed in another intermediate section, or the recesses formed in the back section. However, if desired, the section forming the terminal end of the sectional container need not have recesses 21*a*–21*d* formed therein. If these recesses are omitted, a more aesthetically pleasing and finished exterior is presented.

Figure 6:
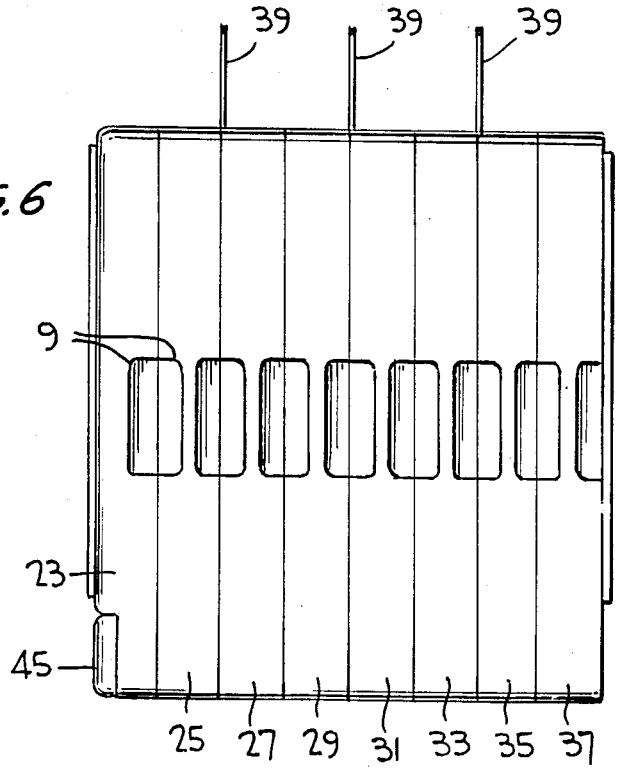
FIG. 6 is a side elevational view of a plurality of sections joined together to form one preferred embodiment of the sectional container of the present invention.

FIG. 6 shows a sectional container capable of holding sixty-four crayons, i.e., a sectional container having a total of eight sections capable of holding eight crayons each. Section 23 is the front section of the container, with sections 25, 27, 29, 31, 33, 35, and 37 being sections interlocked to the front section 23 to increase the holding capacity of the sectional container. Section 37 is the back section which can be either identical to sections 25, 27, 29, 31, 33 and 35, or which can have a smooth rear face without recesses. Identical intermediate sections and/or back section provides for interchangeable pieces and easy assembly or reassembly of the sections. Reassembly is sufficiently easy for a child to perform.

When the sections of the sectional container are detached to provide individual sections, the sections can be used in a tray-like manner, thereby providing a work holder for the items held in the container. Due to the open face of the individual sections, easy access is provided to the items in the container. Further, due to the fact that the various sections serve to close the other section(s), an individual cover or covers is not necessary, thereby avoiding the chance of losing a cover(s) or the necessity of requiring additional work space to accommodate a flip back or other type of attached cover.

The sections making up the container of the present invention can be made of any suitable material, preferably a plastic such as polyethylene or the like. The material utilized to make the container sections can be transparent, colored, or a combination.

As shown in FIG. 1, a window 5 can be formed in the container wall so that the items held within the container can be seen by a consumer. Additionally, the name of the goods or description of the goods can be formed as part of the container wall by any conventional means or by using a label 7, such as shown in FIG. 1, which can encircle the container. The label is removed when the container is to be opened.

A finger gripping portion 9 can be formed in one or more sidewalls of the container section or sections to provide a surface for pulling the sections apart. The gripping surface can take any conventional form, such as an indentation, a raised surface, or a plurality of ribs.

The modular container can also be modified with additional features such as a hanger extending upward from the front or back section and, if desirable, from an intermediate section or sections so that the modular container can be hung from a rack for display purposes. The hanger is denoted as 39 in FIGS. 1, 2, 4, and 6.

The sectional container can be modified by the addition of a sharpener for sharpening the crayons, or other sharpenable items held within the sectional container. The sharpener 41 is preferably formed as an integral part of the front section of the sectional container. The sharpener, as best shown in FIG. 5, contains a conventional sharpening means 43 within the structure. Space is provided within the sharpener for holding collected shavings. The bottom 45 of the front face of the front section of the sectional container is formed as the back wall of the sharpener. Wall portion 45 is hingedly connected to the container so that the wall portion 45 can be swung down, such as shown by the dotted lines in FIGS. 2 and 5, so that the shavings formed when a crayon or other instrument is sharpened can be emptied from the sharpener. The sharpener, however, can be separate and placed in an appropriately sized recess in one of the sections making up the container.

Due to the protrusion of the sharpener from the base of the front section of the sectional container, a hollow 47 is formed in the base of the back section and/or intermediate section of the sectional container so that the front section and back section or intermediate section will fit in a flat complementary relationship to each other. Of course, if a protruding sharpener is not included in the front section, a hollow such as shown in the drawing need not be present.

As will be apparent to one skilled in the art, various modifications can be made within the scope of the aforesaid description. Such modifications being within the ability of one skilled in the art form a part of the present invention and are embraced by the appended claims.

It is claimed:

1. A sectional container comprising (a) a polygonally shaped front section having (1) a front face, sidewalls, and an open-ended rear face providing a cavity within said front section for holding one or more items, and (2) recesses formed in the rear face of said sidewalls in the area of each angle formed by the meeting of said sidewalls of said front section; and (b) a back section with a polygonal shape corresponding to said polygonal shape of said front section, said back section having (1) a rear face, sidewalls, and an open-ended front face providing a cavity within said back section for holding one or more items, and (2) projections protruding from the front face of said sidewalls in the area of each angle formed by the meeting of said sidewalls of said back section.

2. The sectional container according to claim 1 wherein said back section has recesses formed in the rear face of said sidewalls in the area of each angle formed by the meeting of said sidewalls of said back section.

3. The sectional container according to claim 1 wherein said sectional container has at least one intermediate section with a polygonal shape corresponding to said polygonal shape of said front section and said back section, said intermediate section having (1) a rear face, sidewalls, and an open-ended front face providing a cavity within said intermediate section for holding one or more items, (2) projections protruding from the front face of said sidewalls in the area of each angle formed by the meeting of said sidewalls of said intermediate section, and (3) recesses formed in the rear face of said sidewalls in the area of each angle formed by the meeting of said sidewalls of said intermediate section.

4. The sectional container according to claim 1 wherein at least one of said front or back sections has a hanger portion extending upward from said section.

5. The sectional container according to claim 1 wherein said front section has a sharpener as a part thereof.

6. The sectional container according to claim 5 wherein said front section has a reclosable opening formed in said front face of said front section to provide a means of emptying shavings from said sharpener.

7. The sectional container according to claim 1 wherein said front section and said back section have a means of gripping said sections to facilitate separating said sections.

8. The sectional container according to claim 3 wherein said front section, said back section, and said intermediate section have a means of gripping said sections to facilitate separating said sections.

9. A method of assembling a sectional container having (a) a polygonally shaped front section having (1) a front face, sidewalls, and an open-ended rear face providing a cavity within said front section for holding one or more items, and (2) recesses formed in the rear face of said sidewalls in the area of each angle formed by the meeting of said sidewalls of said front section; and (b) a back section with a polygonal shape corresponding to said polygonal shape of said front section, said back section having (1) a rear face, sidewalls and an open-ended front face providing a cavity within said back section for holding one or more items, and (2) projections protruding from the front face of said sidewalls in the area of each angle formed by the meeting of said sidewalls of said back section;

wherein said projections of said back section are aligned with and caused to be seated within said recesses in said front section.

10. The method according to claim 9 wherein said back section has recesses formed in the rear face of said sidewalls in the area of each angle formed by the meeting of said sidewalls of said back section.

11. The method according to claim 9 wherein said sectional container has at least one intermediate section with a polygonal shape corresponding to said polygonal shape of said front section and said back section, said intermediate section having (1) a rear face, sidewalls and an open-ended front face providing a cavity within said intermediate section for holding one or more items, (2) projections protruding from the front face of said sidewalls in the area of each angle formed by the meeting of said sidewalls of said intermediate section, and (3) recesses formed in the rear face of said sidewalls in the area of each angle formed by the meeting of said sidewalls of said intermediate section;

wherein said projections on said intermediate section are aligned with and caused to be seated within said recesses in said front section.

12. The method according to claim 10 wherein said sectional container has at least one intermediate section with a polygonal shape corresponding to said polygonal shape of said front section and said back section, said intermediate section having (1) a rear face, sidewalls and an open-ended front face providing a cavity within said intermediate section for holding one or more items, (2) projections protruding from the front face of said sidewalls in the area of each angle formed by the meeting of said sidewalls of said intermediate section, and (3) recesses formed in the rear face of said sidewalls in the area of each angle formed by the meeting of said sidewalls of said intermediate section;

wherein said projections on said intermediate section are aligned with and caused to be seated within said recesses in said front section or said back section.

13. The method according to claim 9 wherein at least one of said front or back sections has a hanger extending upward from said section.

14. The method according to claim 9 wherein said front section has a sharpener as a part thereof.

15. The method according to claim 14 wherein said front section has a reclosable opening formed in said front face of said front section to provide a means for emptying shavings from said sharpener.

16. The method according to claim 9 wherein said front section and said back section have a means of gripping said sections to facilitate separating said sections.

17. The method according to claim 11 wherein said front section, said back section and said intermediate section have a means of gripping said sections to facilitate separating said sections.

18. The method according to claim 12 wherein said front section, said back section and said intermediate section have a means of gripping said sections to facilitate separating said sections.

* * * * *